United States Patent [19]

Nagao

[11] Patent Number: 5,009,072

[45] Date of Patent: Apr. 23, 1991

[54] REFRIGERATOR

[75] Inventor: Masashi Nagao, Amagasaki, Japan

[73] Assignee: Mitsubishi Denki Kabushiki Kaisha, Tokyo, Japan

[21] Appl. No.: 472,849

[22] Filed: Jan. 31, 1990

[30] Foreign Application Priority Data

May 26, 1989 [JP] Japan ..... 1-133224

[51] Int. Cl.[5] ..... F25B 9/00

[52] U.S. Cl. ..... 62/6; 60/520

[58] Field of Search ..... 62/6; 60/517, 520

[56] References Cited

U.S. PATENT DOCUMENTS

| | | | |
|---|---|---|---|
| 3,148,5127 | 9/1964 | Hoffman et al. | 62/6 |
| 3,413,802 | 12/1968 | Cowans | 62/6 |
| 3,609,982 | 10/1971 | O'Neil et al. | 62/6 |
| 3,937,018 | 2/1976 | Beale | 62/6 |
| 4,143,520 | 3/1979 | Zimmerman | 62/6 |
| 4,366,676 | 1/1983 | Wheatley et al. | 62/6 |
| 4,397,156 | 8/1983 | Heisig et al. | 62/6 |
| 4,425,764 | 1/1984 | Lam | 62/6 |
| 4,498,296 | 2/1985 | Dijkstra et al. | 62/6 |
| 4,845,953 | 7/1989 | Misawa et al. | 62/6 |
| 4,862,694 | 9/1989 | Crunkleton et al. | 62/6 |

FOREIGN PATENT DOCUMENTS 46-30433 9/1971 Japan .

OTHER PUBLICATIONS

Advances in Cryogenic Engineering, vol. 5, Sep. 2-4, 1959, H. O. McMahon and W. E. Gifford, pp. 354-367.

Advances in Cryogenic Engineering, vol. 11, Aug. 23-25, 1965, W. E. Gifford, pp. 152-159.

*Primary Examiner*—Ronald C. Capossela

*Attorney, Agent, or Firm*—Oblon, Spivak, McClelland, Maier & Neustadt

[57] ABSTRACT

A refrigerator comprises a cold accumulator, an expansion chamber, a movable member which is provided in the expansion chamber, and which can move to change the inside volume of the expansion chamber, a compressed operating gas which is introduced into the expansion chamber through the cold accumulator, the gas being expanded under the action of the movable member to generate cold, and being exhausted from the expansion chamber through the cold accumulator, an auxiliary expansion chamber which communicates with the expansion chamber through a narrow flow passage, and an auxiliary movable member which is associated with the movable member, and which can be provided in the auxiliary chamber to change the inside volume of the auxiliary expansion chamber.

10 Claims, 11 Drawing Sheets

REFRIGERATOR

BACKGROUND OF THE INVENTION

1. Field of the Invention

The present invention relates to a refrigerator and is more particularly concerned with a cryogenic refrigerator having improved refrigerating capacity.

2. Discussion of Background

FIG. 10 is a schematic diagram showing the structure of a conventional cryogenic refrigerator which has been disclosed in e.g. Japanese Examined Patent Publication No. 30433/1971 (U.S. Pat. No. 3,281,815). The conventional cryogenic refrigerator is a refrigerator having the Gifford-McMahon cycle. In FIG. 10, reference numeral 1 designates an operating gas (for example helium gas). Reference numeral 2 designates a suction valve for sucking the operating gas 1. Reference numeral 3 designates an exhaust valve for exhausting the operating gas 1. Reference numeral 4 designates a first step expansion chamber. Reference numeral 5 designates a first step displacer as a movable member which reciprocates to move the operating gas 1. Reference numeral 6 designates a first step cold accumulator which is used to accumulate the cold in the operating gas. Reference numeral 7 designates a first step seal which is used to prevent the operating gas 1 in the first step expansion chamber 4 from leaking along the outer periphery of the first step displacer 5. Reference numeral 8 designates a first step refrigerating stage which is used to transfer the cold in the first step expansion chamber 4 to outside. Reference numeral 9 designates a first step cylinder. Reference numeral 10 designates a second step expansion chamber. Reference numeral 11 designates a second step displacer as a movable member which reciprocates to move the operating gas 1. Reference numeral 12 designates a second step cold accumulator which is used to accumulate the cold in the operating gas. Reference numeral 13 designates a second step seal which is used to prevent the operating gas 1 in the second step expansion chamber 10 from leaking along the outer periphery of the second step displacer 11. Reference numeral 14 designates a second step refrigerating stage which is used to transfer the cold in the second step expansion chamber 10 to outside. Reference numeral 15 designates a second step cylinder. Reference numeral 16 designates an electric motor which drives the displacers 5 and 11. Reference numeral 17 designates a driving shaft which is used to transmit a driving force from the electric motor 16 to the displacers. Reference numeral 18 designates a crankshaft for converting the rotational movement of the motor into a reciprocating movement for the displacers. Reference numeral 19 designates a compressor for compressing the operating gas 1. Reference numeral 20 designates a high pressure buffer tank which can minimize variation in the pressure at a higher pressure side. Reference numeral 21 designates a low pressure buffer tank which can minimize variation in the pressure at a lower pressure side. Reference numeral 22 designates a device for maintaining at a constant level the difference in the pressures at the higher pressure side and at the lower pressure side. An arrow 23 designates an amount of refrigeration Q1 which is absorbed by the first step refrigerating stage 8. An arrow 24 designates an amount of refrigeration Q2 which is absorbed by the second step stage 14. The operation of the cryogenic refrigerator will be explained. FIG. 11 is a P-V diagram of the refrigerator.

The ordinate represents the pressures in the first step expansion chamber 4 and the second step expansion chamber 10, and the abscissa represents the volumes in the both chambers. Under the condition at A in FIG. 11, the first step displacer 5 and the second step displacer 11 are at their lowermost positions, and the suction valve 2 and the exhaust valve 3 are opened, causing the pressures in both chambers 4 and 10 to become high. In the course of A-B, the displacers 5 and 11 are raised, causing the operating gas 1 having high pressure to be introduced from the compressor 19 into the expansion chambers 4 and 11 while being cooled in the cold accumulators 6 and 12. The cold accumulators 6 and 12 have such temperature gradients that the temperature at the upper end of the first step cold accumulator 6 is e.g. 300 K, the lower end of the first step cold accumulator is e.g. 50 K, the upper end of the second step cold accumulator 12 is e.g. 50 K and the lower end of the second step cold accumulator is e.g. about 10 K. In this case, the operating gas 1 which has been introduced into the first step expansion chamber 4 is cooled to about 50 K, and the operating gas 1 which has been introduced into the second step expansion chamber 10 is cooled to about 10 K. The volumes in the expansion chambers become maximum at B. At this time, the cold accumulators have temperature distributions which are at higher levels than their initial temperature distributions because the cold accumulators have been heated by the operating gas 1. In the course of B-C, the suction valve 2 is closed while the exhaust valve 3 is opened. In this course, the operating gas 1 is expanded to change from a high pressure state to a low pressure state to generate cold in the expansion chambers 4 and 10. The principle of this cold generation is indicated in FIG. 12. Firstly, the operating gas 1 having high pressure which is in the second step expansion chamber 10 under the condition B is imaginarily divided in x1 to x7. When the exhaust valve 3 is opened, the portion x1 of the operating gas 1 flows out to achieve the condition of b1. As a result, the portions x2 to x7 of the operating gas 1 expand, causing the temperature of the operating gas to lower. Next, the portion x2 of the operating gas 1 flows out to achieve the condition of b2. As a result, the portions of x3 to x7 of the operating gas 1 expand, causing the temperature of the operating gas to be further lowered. Such process is repeated, leading to the condition of C. The change from the condition of B to the condition of C is substantially an adiabatic change because the change from the condition of B to the condition of C instantly occurs and heat transfer with the second step refrigerating stage 14 is poor. The operating gas 1 thus expanded receives at the first step refrigerating stage 8, the amount of heat which is a portion of the amount of refrigeration Q1, and also receives, at the second step refrigerating stage 14, the amount of heat which is a portion of the amount of the refrigeration Q2. Next, the operating gas 1 cools both cold accumulators 6 and 12, and then returns to the compressor 19. At the condition of C, the pressures in the expansion chambers 4 and 10 are low. In the course of C-D, the displacers 5 and 11 move downward to exhaust the operating gas 1 whose pressure has lowered. The expanded operating gas 1 which is exhausted in this course also receives, at the first step refrigerating stage 8, the amount of heat which is the remaining portion of the amount of refrigeration Q1, and further receives, at the second step refrigerating stage 14, the amount of heat which is the remaining portion of the amount of refrigeration of Q2. The operating gas 1 cools the cold accumulators 6 and 12, and then returns to the compressor 19. In the course of D-A, the exhaust valve 3 is closed while the suction valve 2 is opened, causing the pressures in the expansion chambers to change from the low level to the high level. In this way, one cycle is completed. In the course of B-D, the cold accumulators 6 and 12 are cooled to recover the temperature distribution which is similar to that at the beginning of the cycle.

Since the conventional cryogenic refrigerator is constructed as above-mentioned, the change from B to C is an adiabatic change, causing the amount of refrigeration to decrease. In addition, heat transfer with the refrigerating stages 8 and 14 is not enough, the operating gas 1 enters into the cold accumulators 6 and 12 having temperature gradients, with the operating gas 1 being kept cold. That creates a problem wherein generated cold can not be fully utilized and refrigeration efficiency lowers. In particular, the loss at the second step refrigerating stage 12 introduces a problem.

SUMMARY OF THE INVENTION

It is an object of the present invention to solve the problems as above-mentioned and to provide a new and improved refrigerator capable of bringing the change from B to C at the second step refrigerating stage near isothermal change, increasing the amount of refrigeration, and promoting heat exchange to fully utilize generated cold, thereby improving refrigeration efficiency.

The foregoing and other objects of the present invention have been attained by providing a refrigerator comprising a cold accumulator, an expansion chamber, a movable member which is provided in the expansion chamber, and which can move to change the inside volume of the expansion chamber, a compressed operating gas which is introduced into the expansion chamber through the cold accumulator, the gas being expanded under the action of the movable member to generate cold, and being exhausted from the expansion chamber through the cold accumulator, an auxiliary expansion chamber which communicates with the expansion chamber through a narrow flow passage, and an auxiliary movable member which is associated with the movable member, and which can be provided in the auxiliary expansion chamber to change the inside volume of the auxiliary expansion chamber.

The auxiliary expansion chamber can be defined by a recessed portion formed in the leading edge of the auxiliary movable member and a convex portion formed on an internal surface of the auxiliary expansion chamber, the convex portion being engageable with the recessed portion at the time of compression.

The auxiliary movable member can be made of a uniformly heated material.

In the refrigerator according to the present invention, the expansion chamber is connected to the auxiliary expansion chamber. As a result, in the expansion process of B-C, the operating gas which flows out of the auxiliary expansion chamber agitates the operating gas in the expansion chamber to promote heat exchange with the refrigerating stage, thereby bringing the expansion process to an isothermal process, increasing the amount of refrigeration, and allowing the operating gas to enter the cold accumulator after having been fully heat exchanged. In this way, loss is minimized.

In addition, the auxiliary expansion chamber can be constituted by a recessed portion formed in the leading edge of the movable member, and a convex portion formed on an internal surface of the expansion chamber and engageable with the recessed portion at the time of compression to increase heat transmitting area, to improve refrigerating efficiency, and make the size of the refrigerator compact.

Further, the auxiliary movable member can be made of a uniformly heated material to bring the expansion process near to the isothermal process.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Now, the present invention will be described in detail with reference to the preferred embodiments illustrated in the accompanying drawings.

Figure 1:
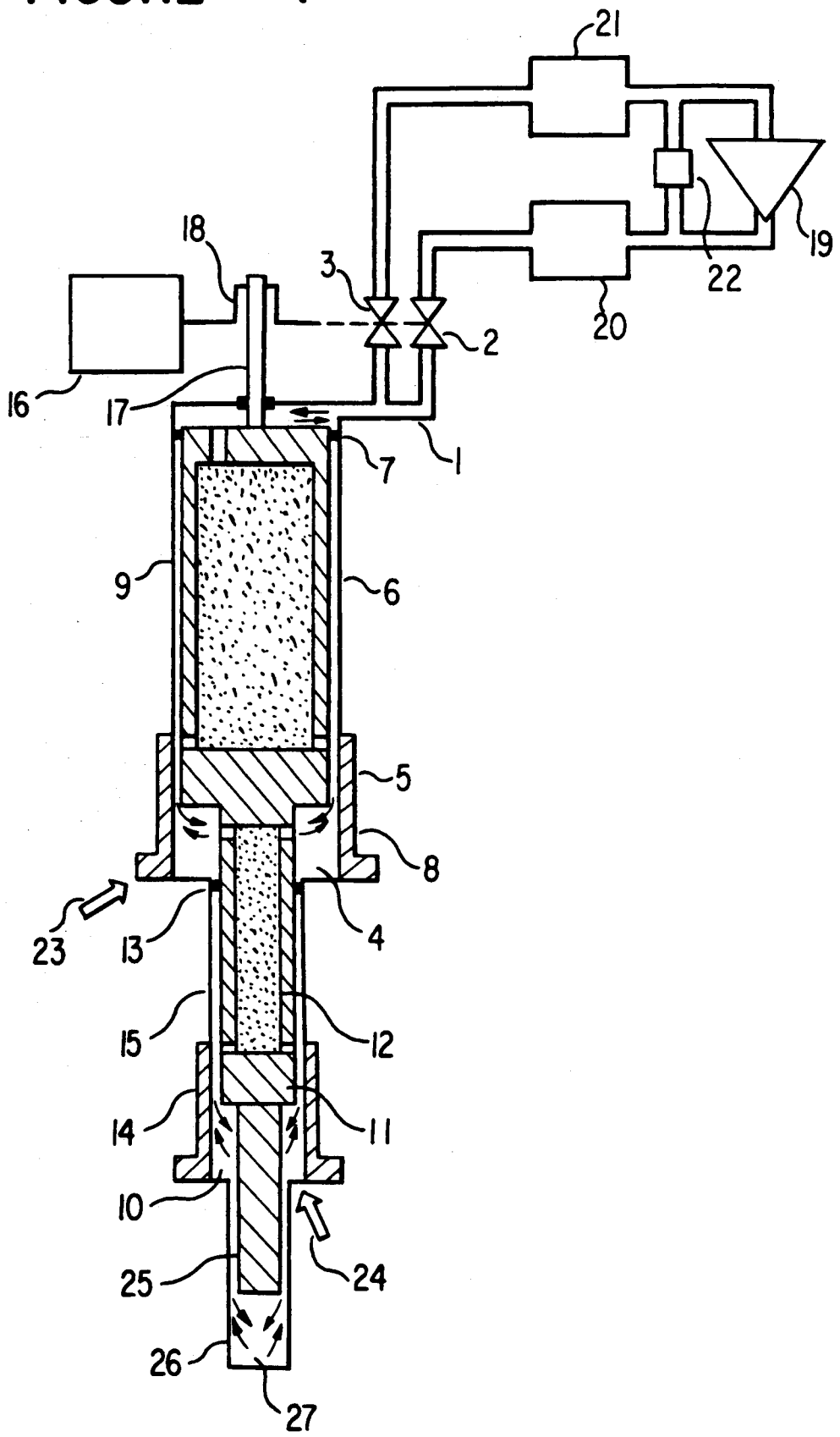
FIG. 1 is a schematic diagram showing the structure of an embodiment of the cryogenic refrigerator according to the present invention.

FIG. 1 is a schematic diagram showing the structure of a first embodiment of the refrigerator according to the present invention. In FIG. 1, the parts indicated in reference numerals 1 through 24 are the same as those of the conventional refrigerator. Reference numeral 25 designates an auxiliary displacer which is attached to the second step displacer 11 and is surrounded by second step expansion chamber 10. Reference numeral 26 designates an auxiliary cylinder which connects to the second step cylinder 15. Reference numeral 27 designates an auxiliary expansion chamber where a portion of the operating gas 1 expands, and which communicates with the second step expansion chamber 10 through a narrow fluid passage.

Figure 2:
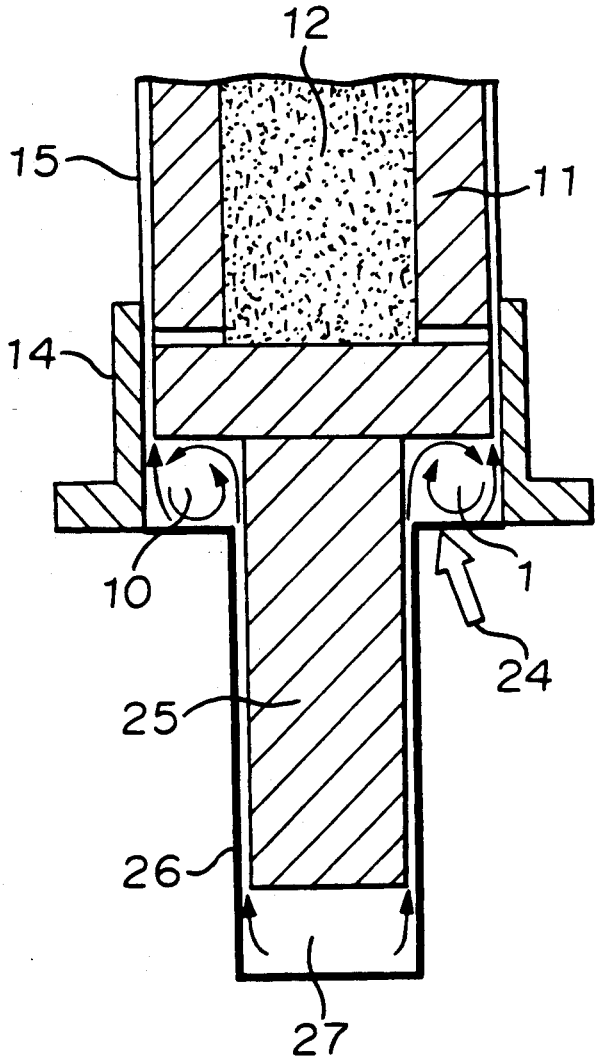
FIG. 2 is a schematic diagram showing the operational principle of the cryogenic refrigerator of the embodiment.
Figure 3:
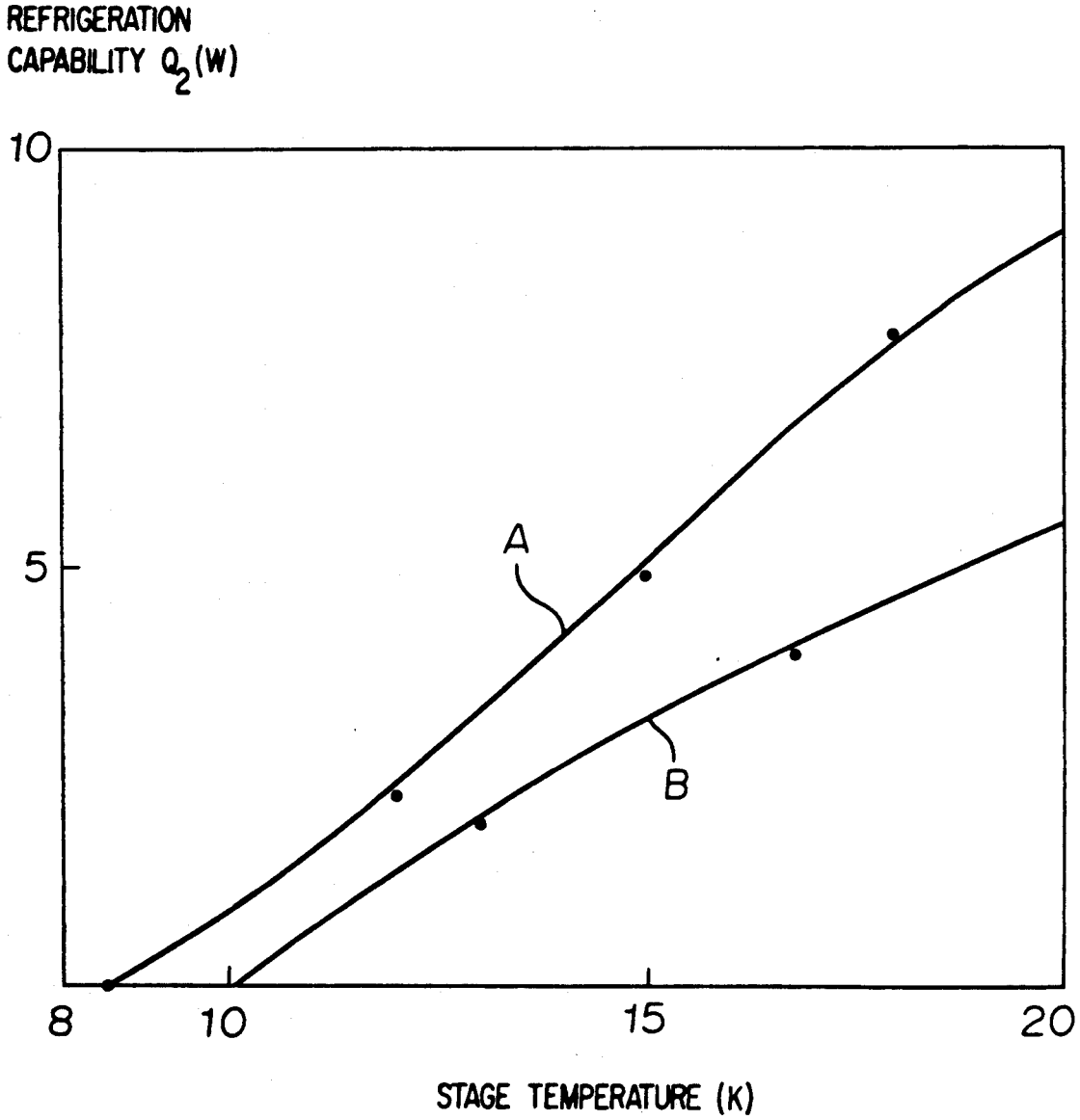
FIG. 3 is a graphical representation showing the characteristics of the refrigerating capacities of the refrigerator of the embodiment and a conventional refrigerator.

In accordance with the cryogenic refrigerator as constructed above, the operating gas 1 which has expanded in the auxiliary expansion chamber 27 flows into the second step expansion chamber 10 through a gap between the auxiliary displacer 25 and the auxiliary cylinder 26 to agitate the operating gas 1 in the second step expansion chamber 10 during the change of state from B to C as shown in FIG. 2. As a result, heat exchange with the second step refrigerating stage 14 is promoted, causing the expansion process of B-C to approach isothermal change. The promoted heat exchange enables the operating gas 1 entering the second step cold accumulator 12 to be fully cooled. FIG. 3 is a graphical representation showing the characteristics of the refrigerating capacity of the cryogenic refrigerator according to the embodiment and that of the conventional cryogenic refrigerator. This graphical representation shows that the refrigerating capacity (indicated in a curve A) of the cryogenic refrigerator according to the present invention is about 1.5 times that of the conventional cryogenic refrigerator(indicated in curve B). In this embodiment, the auxiliary cylinder 26 is made of a stainless steel, and the auxiliary displacer 25 is made of bakelite.

In the first embodiment, the auxiliary cylinder 26 and the auxiliary displacer 25 are made of the material having small thermal conductivity. The auxiliary cylinder and the auxiliary displacer can be made of material having large thermal conductivity, (e.g. copper or aluminum) to decrease the temperature difference between the auxiliary expansion chamber 27 and the second step refrigerating stage 14, allowing the refrigerating capacity at the second step refrigerating stage 14 to be further improved.

The auxiliary displacer 25 can be made of material having large specific heat, such as uniformly heated material comprising alloy (e.g. GdRh) containing copper or rare earth metal, to bring the expansion process nearer to the isothermal process, thereby increasing the amount of refrigeration.

Figure 4:
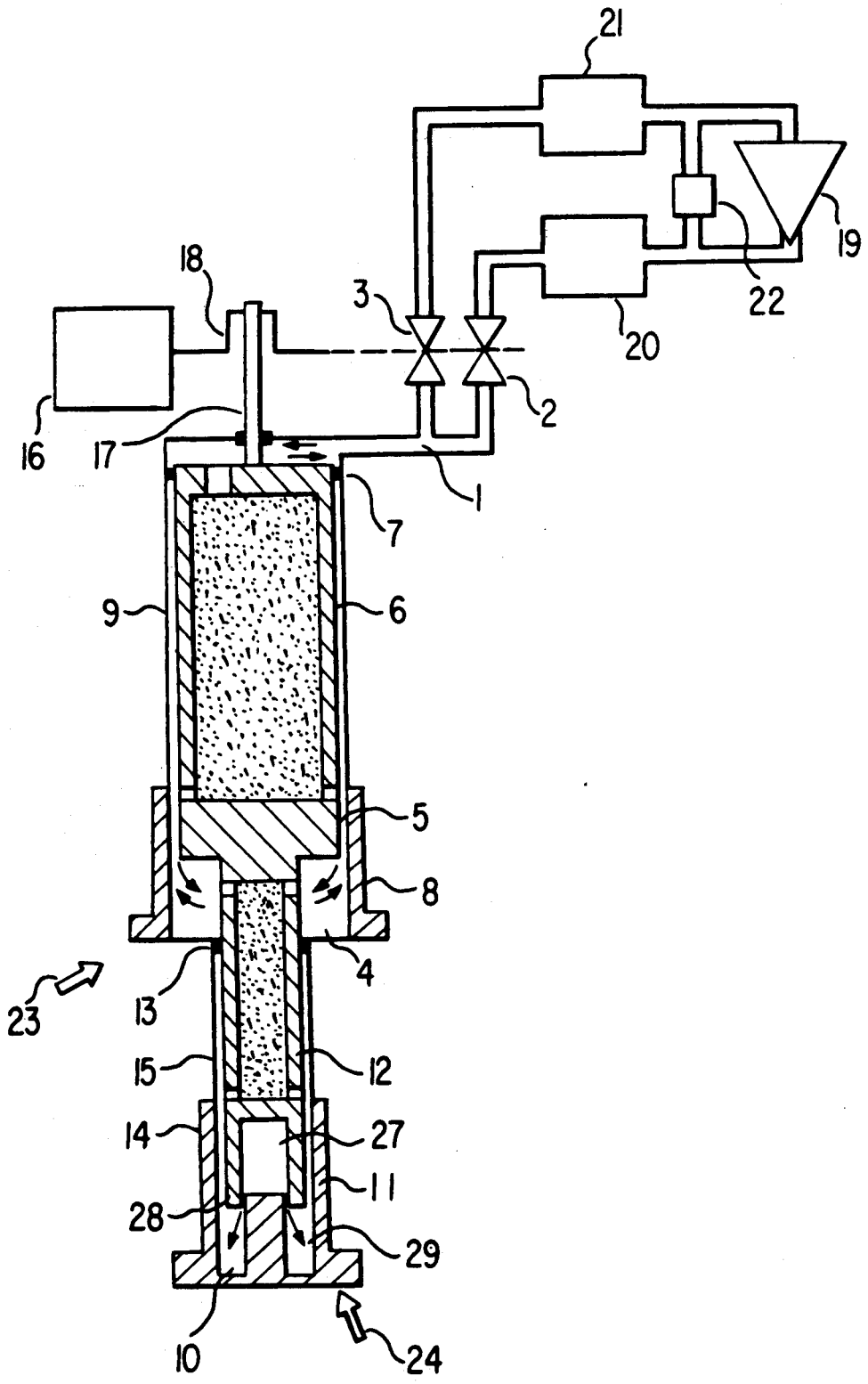
FIG. 4 is a schematic diagram showing the structure of the cryogenic refrigerator of a second embodiment.

FIG. 4 is a schematic diagram showing the structure of a second embodiment of the cryogenic refrigerator according to the present invention. The parts indicated in reference numerals 1 through 24 are the same as those of the conventional refrigerator as stated earlier. Reference numeral 28 designates a recessed portion which is formed in the leading edge of the second displacer 11. Reference numeral 29 designates a convex portion which is formed on an internal surface of the bottom of the second step cylinder 15, is surrounded by expansion chamber 10, and which made of material having a large thermal conductivity (e.g. copper). In the second embodiment, the convex portion is integrally formed with the second step refrigerating stage 14. Reference numeral 27 designates an auxiliary expansion chamber which is defined by the convex portion 29 and the recessed portion 28, and where a portion of the operating gas 1 expands. The convex portion 29 and the recessed portion 28 are engaged with each other at the time of compressing the operating gas 1.

Figure 5:
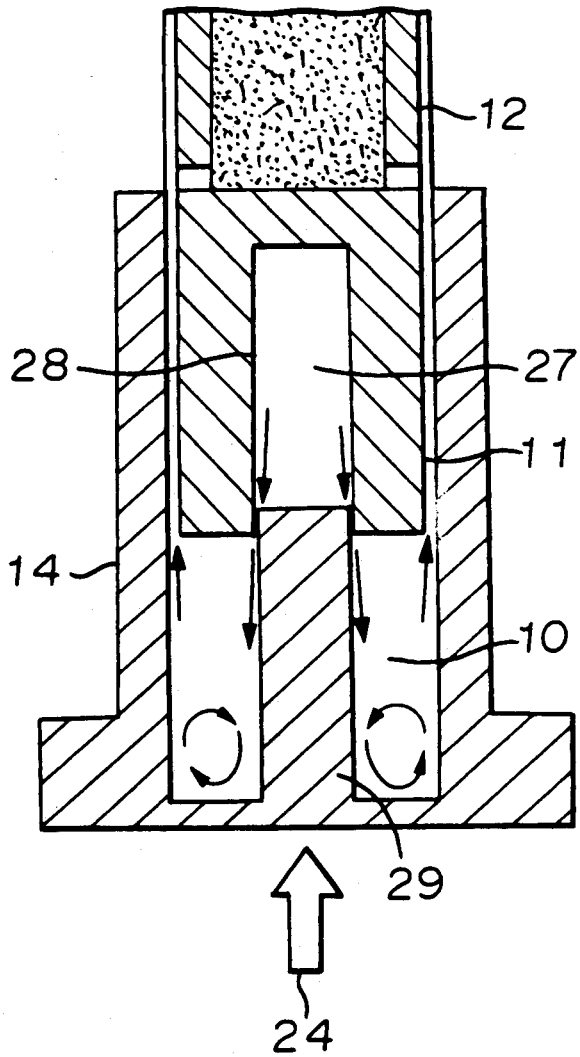
FIG. 5 is schematic diagram showing the operation principle of the cryogenic refrigerator of the second embodiment.

In accordance with the cryogenic refrigerator of the second embodiment, the operating gas 1 which has expanded in the auxiliary expansion chamber 27 flows from the auxiliary expansion chamber 27 into the second step expansion chamber 10 through a gap between the inner peripheral surface of the recessed portion 28 and the outer peripheral surface of the convex portion 29 to agitate the operating gas 1 in the second step expansion chamber 10 during the change of state from B to C as shown in FIG. 5. As a result, heat exchange with the second step refrigerating stage 14 is promoted, allowing the expansion process of B-C to approach isothermal change. In addition, the heat exchanging area is increased by the surface area of the convex portion 29 to promote heat exchange. In this way, the operating gas 1 which enters the second step cold accumulator 12 can be fully cooled. Further, this arrangement allows the size of the device to be compact.

In the second embodiment, the convex portion 29 is made of material having a large thermal conductivity. Material having a large specific heat (hereinbelow, referred to as uniformly heated material) can be attached on the convex portion to increase heat capacity, allowing the expansion process to be brought nearer to the isothermal process, and the amount of refrigeration to be increased.

Figure 6:
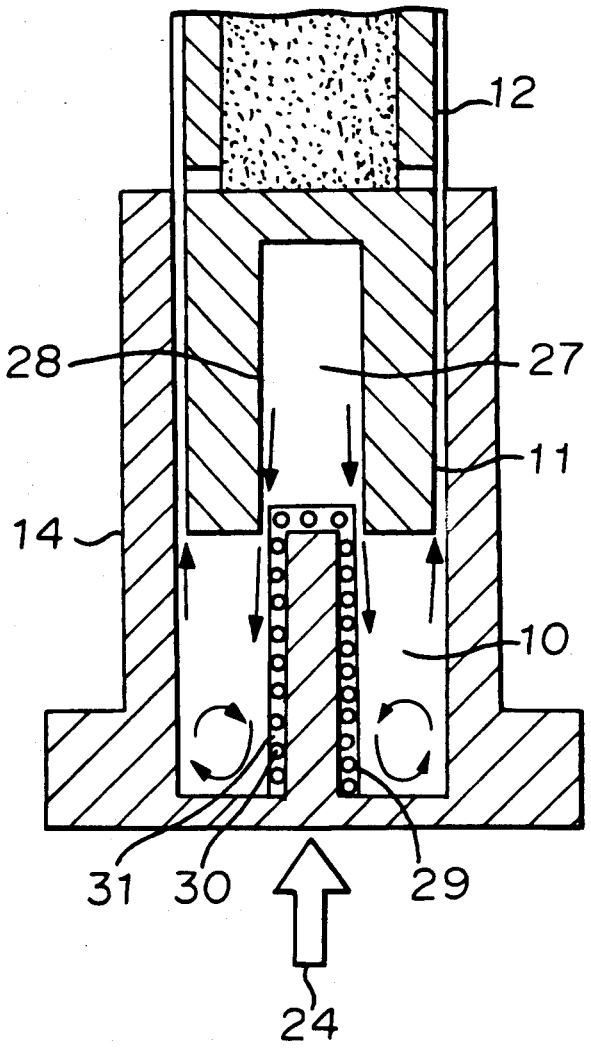
FIGS. 6 through 9 are schematic diagrams showing the essential portions of the refrigerators of third through sixth embodiments.

FIG. 6 shows a third embodiment wherein a uniformly heated material 30, such as alloy containing copper or rare earth metal, or chemical compound (e.g. GdRh), is attached on the outer surface of the convex portion 29. An adhesive 31 having a large thermal conductivity is used to attach the uniformly heated material 30 to the outer surface in good thermal contact.

Figure 7:
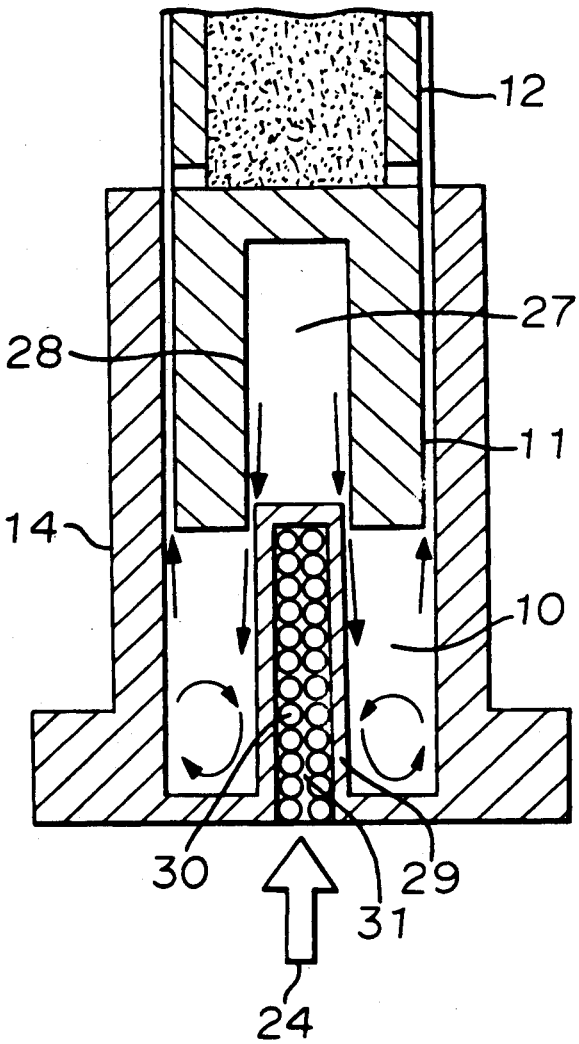

FIG. 7 shows a fourth embodiment wherein the uniformly heated material 30 is attached on the internal surface of the convex portion 29. An adhesive 31 having a large thermal conductivity is used to attach the uniformly heated material 30 to the inner surface in good thermal contact.

Figure 8:
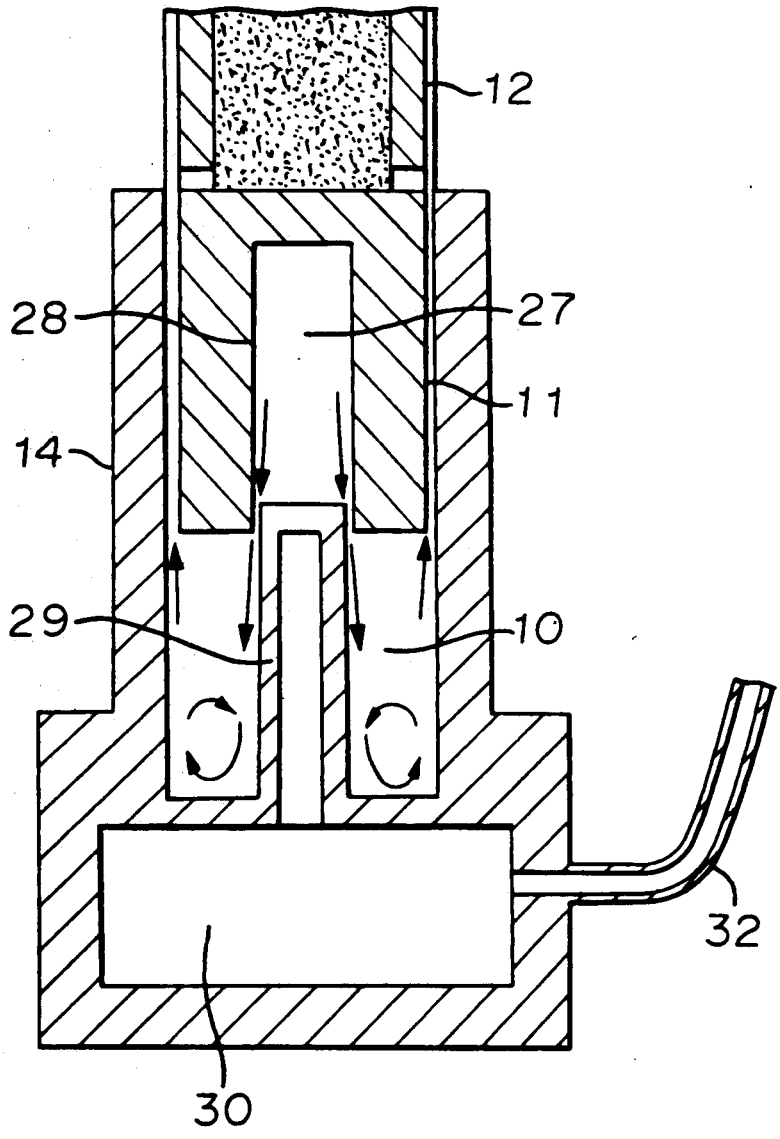
Figure 9:
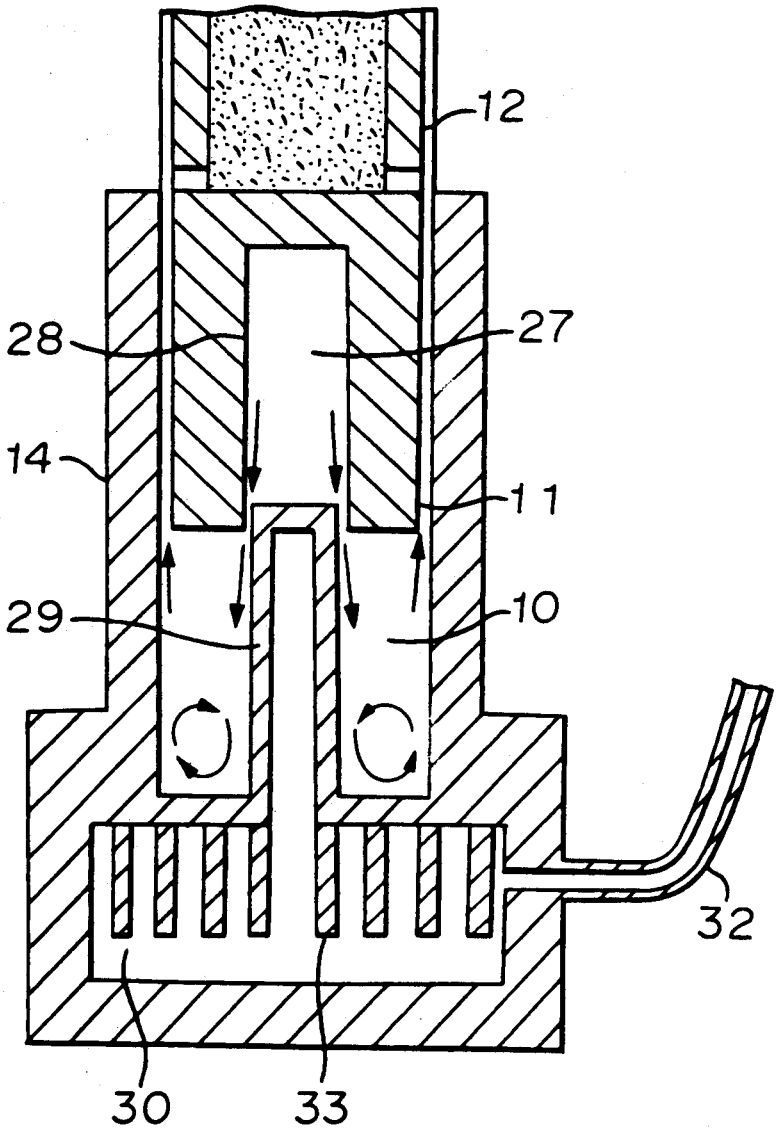
Figure 10:
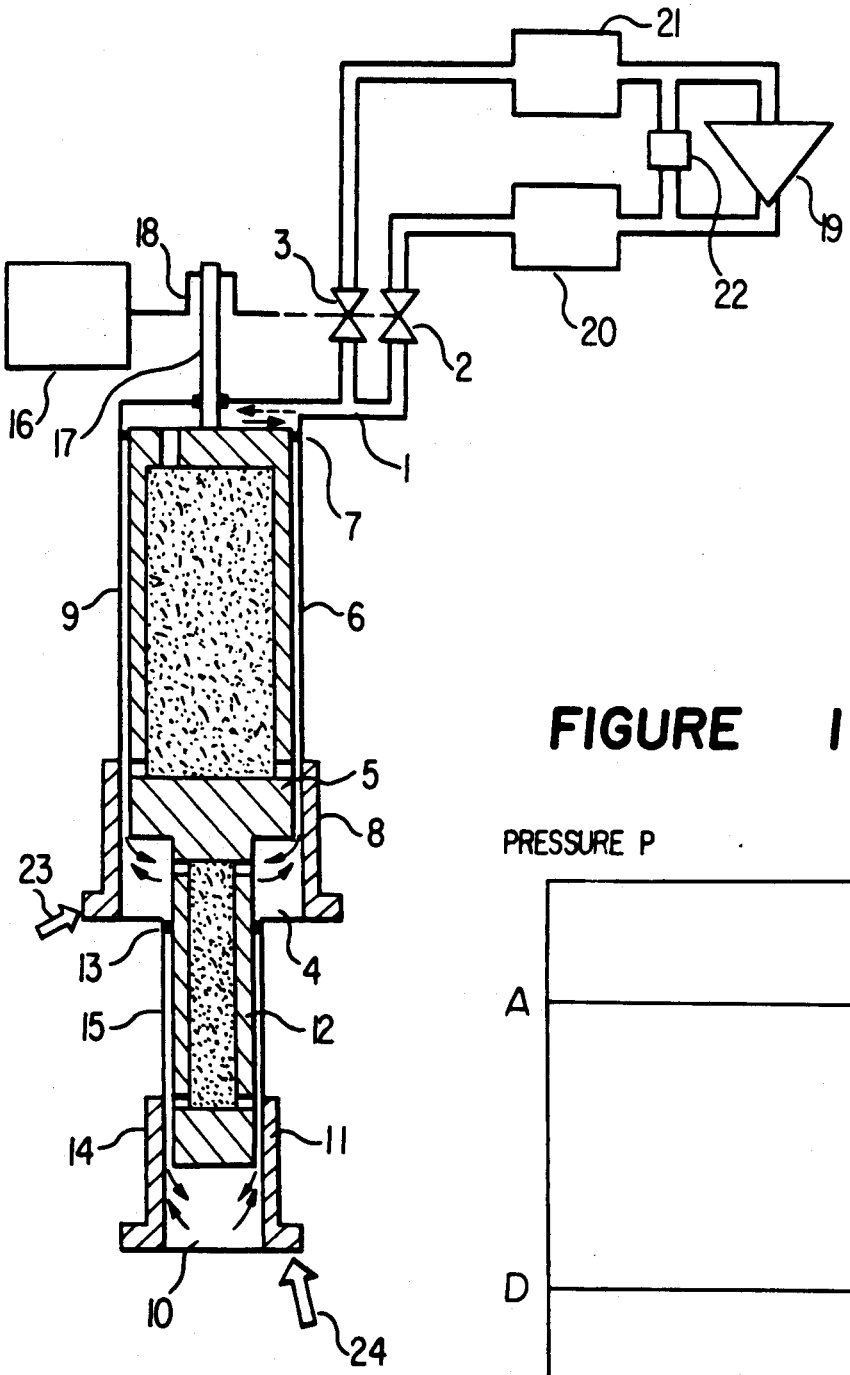
FIGURE 10 PRIOR ART
FIG. 10 is a schematic diagram showing the structure of a conventional cryogenic refrigerator.
Figure 11:
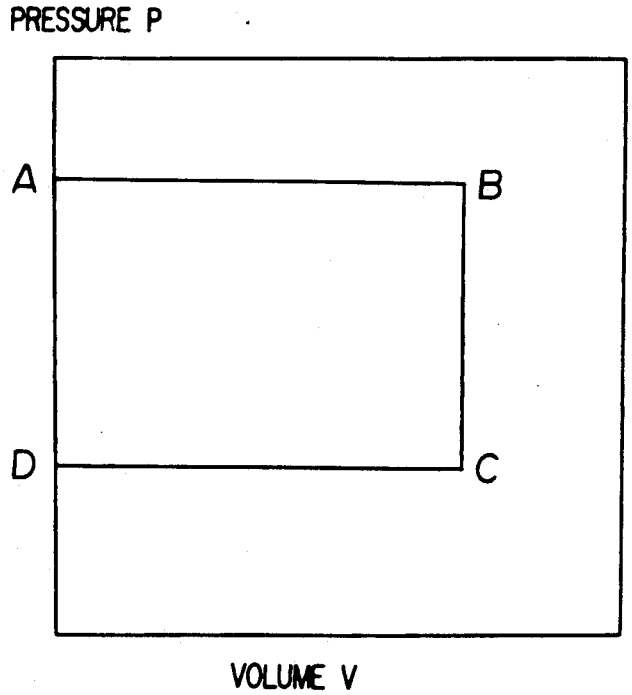
FIG. 11 is a graphical representation showing the P-V characteristic of the cryogenic refrigerator.
Figure 12:
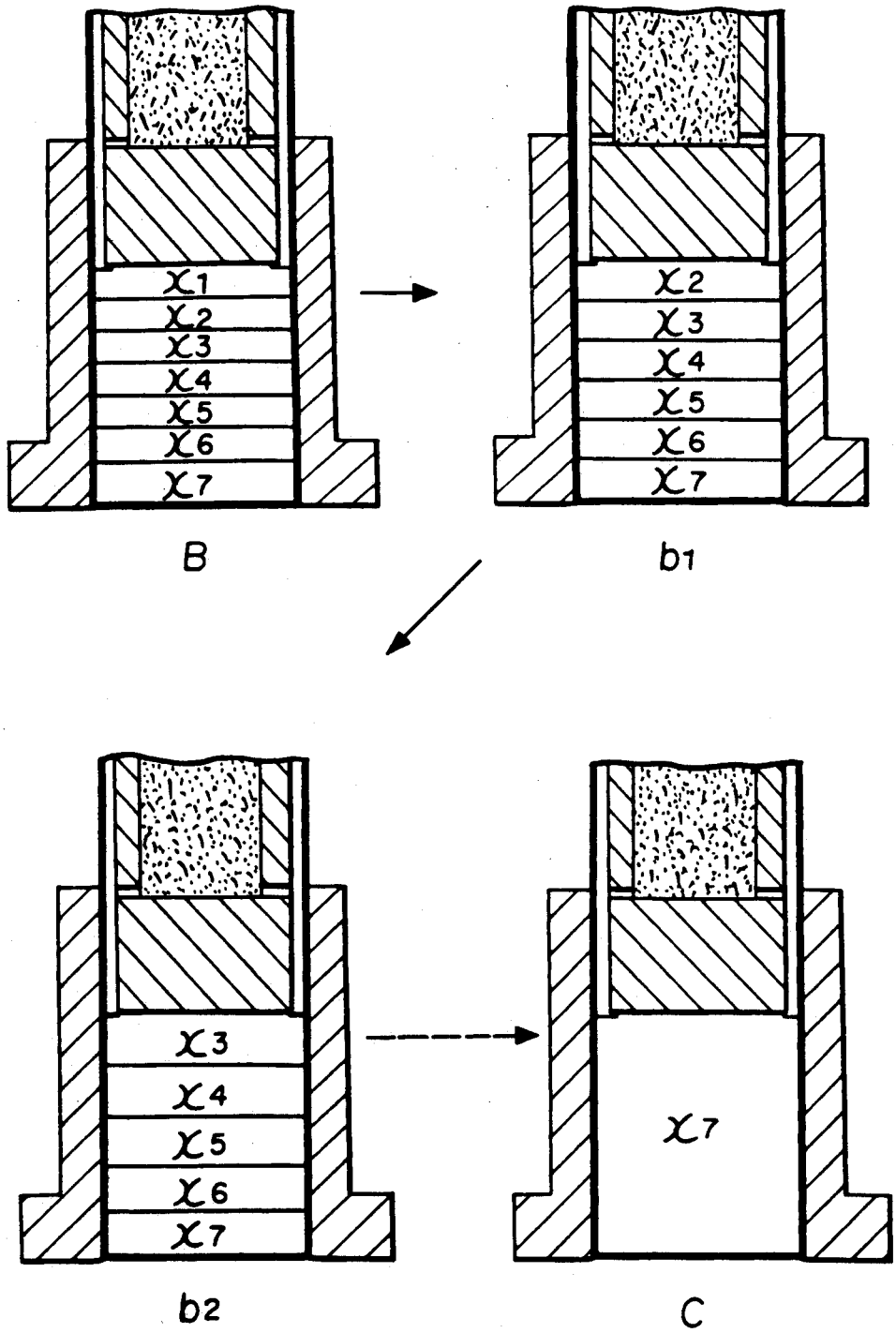
FIGS. 12 (A)-(D) are schematic diagrams explaining in sequence the principle of cold generation by expansion.

FIG. 8 is a fifth embodiment wherein the uniformly heated material 30 is arranged inside of the convex portion 29. Helium gas or liquid helium, which has a large specific heat at temperatures below 10 K, can be utilized as the uniformly heated material 30. Reference numeral 32 designates a tube for introducing helium gas or liquid helium. In the fifth embodiment, an enlarged heat transmitting surface 33 as shown in FIG. 9 can be provided inside of the convex portion 29 to further increase the amount of refrigeration. The devices having the structures shown in FIGS. 8 and 9 can be used as a helium liquifier.

Although in the third through sixth embodiments, the uniformly heated material 30 is attached on either the outer surface or the inner surface of the convex portion, the uniformly heated material can be attached on both the outer surface and the inner surface.

Although the explanation on the first through sixth embodiments has been made in reference to the Gifford-McMahon type refrigerator, the present invention is also applicable to a refrigerator having other refrigeration cycle, such as a Sterling cycle refrigerator, a Vuilleumier type of refrigerator or a Solvay type of refrigerator.

Although in the first through sixth embodiments the explanation has been made in reference to the two step type of refrigerator, the present invention is also applicable to a single step type or more than two step type of refrigerator.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigerator which comprises:

a cold accumulator, an expansion chamber which includes a convex portion and a recessed portion which surrounds said convex portion, a movable member which is provided in the expansion chamber, and which can move to change the inside volume of the expansion chamber, a compressed operating gas which is introduced into the expansion chamber through the cold accumulator, the gas being expanded under the action of the movable member to generate cold, and being exhausted from the expansion chamber through the cold accumulator, a recessed auxiliary expansion chamber which communicates with the expansion chamber through a narrow flow passage formed between said recessed portion of auxiliary expansion chamber and said convex portion of said recessed expansion chamber, and an auxiliary movable member which is associated with the movable member, and which can be provided in the auxiliary expansion chamber to change the inside volume of the auxiliary expansion chamber.

2. A refrigerator according to claim 1, wherein the auxiliary movable member is made of a uniformly heated material.

3. A refrigerator which comprises:

a cold accumulator, an expansion chamber, a movable member which is provided in the expansion chamber, and which can move to change the inside volume of the expansion chamber, a compressed operating gas which is introduced into the expansion chamber through the cold accumulator, the gas being expanded under the action of the movable member to generate cold, and being exhausted from the expansion chamber through the cold accumulator, an auxiliary expansion chamber which communicates with the expansion chamber through a narrow flow passage, and an auxiliary movable member which is associated with the movable member, and which is provided in the auxiliary expansion chamber to change the inside volume of the auxiliary expansion chamber, wherein the auxiliary expansion chamber is defined by a recessed portion formed in the leading edge of the auxiliary movable member and a convex portion formed on an internal surface of the auxiliary expansion chamber, the convex portion being engageable with the recessed portion at the time of compression.

4. A refrigerator according to claim 3, wherein the auxiliary movable member is made of a uniformly heated material.

5. A refrigerator according to claim 3, wherein uniformly heated material is attached on the outer surface of the convex portion.

6. A refrigerator according to claim 3, wherein uniformly heated material is attached on the inner surface of the convex portion.

7. A refrigerator according to claim 3, wherein uniformly heated material is arranged in the inside of the convex portion.

8. A refrigerator according to claim 7, wherein the uniformly heated material is liquid helium.

9. A refrigerator according to claim 7, wherein the uniformly heated material is helium gas.

10. A refrigerator according to claim 3, wherein an enlarged heat transmission surface is provided on the inner surface of the convex portion.

* * * * *